United States Patent [19]

Pedgonay

[11] 4,375,136

[45] Mar. 1, 1983

[54] MUZZLE CONTROL THROUGH APPLICATION OF TORQUE DERIVED FROM RECOIL ENERGY

[76] Inventor: John S. Pedgonay, 53 E. Bel Air Ave., Aberdeen, Md. 21001

[21] Appl. No.: 288,533

[22] Filed: Jul. 30, 1981

[51] Int. Cl.[3] ..... F41C 21/22

[52] U.S. Cl. ..... 42/75 B; 89/163

[58] Field of Search ..... 42/75 B, 76 R; 89/14 R, 89/16, 42 R, 44 R, 44 A, 160, 163, 177, 178

[56] References Cited

U.S. PATENT DOCUMENTS 553,990 2/1896 Kerpely ..... 89/42 R 3,030,865 4/1962 Ridnour ..... 89/16

4,130,959 12/1978 Pedgonay ..... 42/75

*Primary Examiner*—Stephen C. Bentley

*Attorney, Agent, or Firm*—John F. McClellan, Sr.

[57] ABSTRACT

A system for controlling muzzle torsional movement about the axis of a rifled gun tube during firing by applying to the muzzle a counter-torque symmetrical about the gun tube axis and derived from recoil energy through cam-relation of the gun cradle with a torque tube connecting the gun cradle and muzzle; preferably the cam relation includes a plurality of aperture symmetrically located about the gun tube axis in the breech and of the torque tube, engaging a respective plurality of cam followers on the gun cradle.

15 Claims, 5 Drawing Figures

MUZZLE CONTROL THROUGH APPLICATION OF TORQUE DERIVED FROM RECOIL ENERGY

FIELD OF THE INVENTION

This invention relates generally to weapons and specifically to improving trajectory of projectiles fired from rifled ordnance and the like.

BACKGROUND OF THE INVENTION

Projectile-spin perturbation has long been known as a source of inaccuracy and a practical resolution of the problem has been sought.

PRIOR ART

In U.S. Pat. No. 4,130,959 the present inventor set out in some detail the problems of trajectory perturbation caused by torsional motion of the muzzle during exit of projectile, and disclosed the broad principle of constraining such torsional motion by fixing the muzzle in rotation during firing.

OBJECTS OF THE INVENTION

A principal object of this invention is to provide an improved system for inhibiting rotation of the muzzle of a rifled barrel during firing by concurrently applying a counter-rotation force to the muzzle, an with little or no more hindrance to pointing than without the invention.

Further objects are to provide a system as described which is adaptable to various size pieces from the largest to the smallest in which the gun tube recoils relative to the cradle by providing a recoil-generated direct-acting non-linear counter-torque at the muzzle, with very little complication in mechanism.

BRIEF SUMMARY OF THE INVENTION

In brief summary given as cursive description only and not as limitation, the invention includes a self-contained system for applying during firing a positive counter-torque symmetrical about the long axis of a rifled gun tube to the muzzle end of the gun tube, and derived through independent cam-linkage between the gun cradle and the muzzle.

BRIEF DESCRIPTION OF THE DRAWINGS

The above and other objects and advantages of this invention will become more readily apparent on examination of the drawings, in which like characters refer to like parts.

DETAILED DESCRIPTION OF THE DRAWINGS

Figure 1:
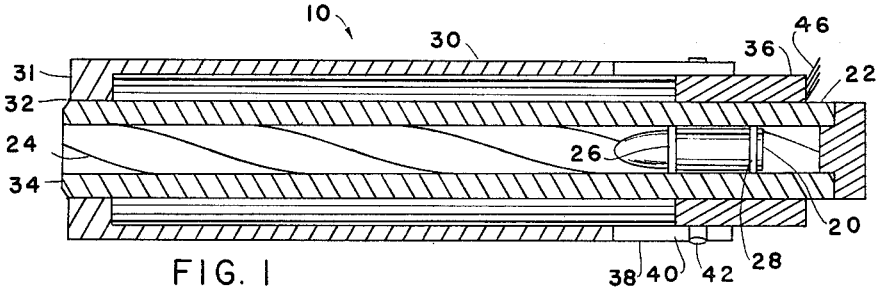
FIG. 1 is a side elevational diagram in section of a rifled tube equipped with the system of this invention, in prefiring position.

FIG. 1 diagrams a preferred embodiment 10 of the invention. A conventional projectile 20 in a conventional rifled gun tube 22 is diagrammed in typical prior-to-firing position. In accordance with well known principles, when fired, the projectile as it accelerates along the gun tube simultaneously will be accelerated in rotation by engagement of the rifling 24 with portions of the shell, here diagrammed as forward and rear sabots 26, 28. The rotational acceleration will cause a reaction torque imparting a longitudinal twist to the barrel, which when relieved progressively as the projectile emerges can counter-rotate and imbalance the emerging projectile, and detract from accuracy.

THE INVENTION

Figure 2:
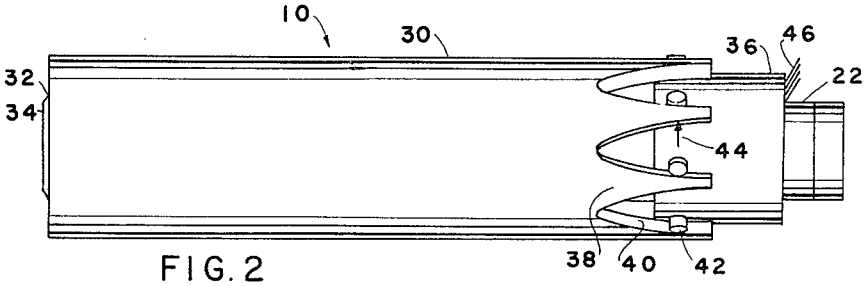
FIG. 2 is an exterior view of the system in pre-firing position.
Figure 4:
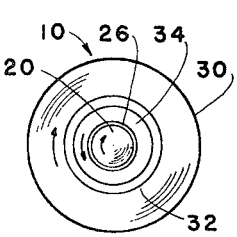
FIG. 4 is a view taken at 4—4, FIG. 3.
Figure 3:
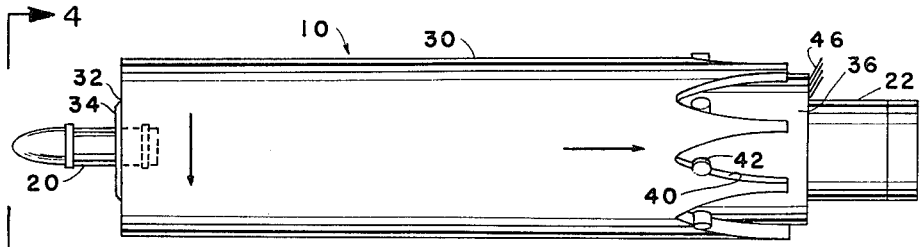
FIG. 3 is a diagram similar to that of FIG. 1, but in a firing position in which the projectile is emerging from the muzzle.

The Figure further shows, in conjunction with FIGS. 2, 3, and 4, a compact system for imparting a corrective counter-torque to the muzzle of the gun tube, according to a preferred embodiment.

A rigid torque tube 30 has at the first end an inward shoulder 31 with a welded connection 32 or other similarly rigid connection with the gun 22 adjacent the muzzle 34 and extends rearwardly along the gun tube, but not tightly fitted to it, past at least a portion of the gun cradle 36 which slidably holds the gun tube in conventional manner. The gun tube circumference may fit in the cradle as an example, but further details of the holding and of recoil and counter-recoil mechanisms are omitted for clarity, and, in any case, may follow conventional principles.

The torque tube may be cylindrical and coaxial with the gun tube, and may fit over a cylindrical portion of the cradle. It may terminate at the cradle in an apertured or in a serrated circumferential end comprising a plurality of arms 38 defining a plurality of cam surfaces 40.

Each cam surface is similarly inclined with respect to the gun tube axis and engaged by a respective cam follower 42 fixed to the cradle 36. Any suitable bias such as a spring (arrow 44, FIG. 2) may be used to keep the cams and followers in contact.

The cam arms 38 may be tapered and of resilient steel to produce a desired acceleration curve and to flex and spread the loads shared among them in circular symmetry. To assure conformance to the cam followers on recoil and counter-recoil they may be preloaded against the cam followers.

The cradle is conventionally coupled to support as indicated by symbols 46, which may represent field gun structure, turret or other ship structure, or any other suitable support which is either rigid, massive, or both.

OPERATION

On firing, recoil of the torque tube 30 with the gun tube 22 forces the inclined cam surfaces 40 rearwardly past the cam followers 42, progressively imparting an axially symmetrical torque through the torque tube connection 32 to the muzzle 34, to counter the torque on the gun tube caused by projectile acceleration.

The cam surfaces may be contoured according to known art to produce a linear or a non-linear torque curve in relation to recoil travel.

FIG. 4 diagrams relative directions in this example: if projectile 20 clockwise, then muzzle 34 counterclockwise, and torque tube 30 clockwise.

Figure 5:
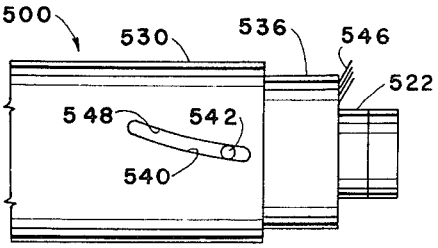
FIG. 5 is a fragmentary detail of a second embodiment in side elevational view.

FIG. 5 shows that the torque member 530 may have one or more closed-end cam slots, each forming a cam surface 540, with a uniformly spaced opposed slot edge 548 to keep the cam follower 542 in contact with the cam surface.

It will be appreciated that the exact coupling mechanism employed between torque tube and cradle will be a matter of choice given the principles of this invention. For example, a single cam follower can be used, or the cam or cams can be on the cradle and the follower or followers on the torque tube. The cam-cam follower structure can both be substantially rigid with heavier proportions if desired, within the spirit of the invention.

The torque tube can be relatively lightweight but stiff because of the substantially larger diameter than the gun tube. It may have ventilation openings or other provision for cooling. A torque member serving the same function but not exactly tubular may be within the spirit of the invention.

Because a part of the recoil energy is expended usefully in countering muzzle twist, the conventional recoil and counter-recoil mechanisms will be less stressed than otherwise. The cam surfaces can be other than arcuate in contour, although preferably they tend in a radial direction at all points.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for applying a torque to a rifled gun tube muzzle for countering torque applied in a first direction about the long axis of the gun tube to said gun tube muzzle by projectile firing therefrom, the gun tube slidably supported in a cradle for recoil, comprising: a torque member having first and second ends, means connecting the torque member first end to the gun tube adjacent the gun tube muzzle, and means on the cradle and on the torque member for applying torque to the torque member second end in a second direction counter to said first direction, upon said recoil.

2. A system as recited in claim 1, said means on the cradle and on the torque member comprising at least one cam follower and one cam surface associated therewith.

3. A system as recited in claim 1, said means on the cradle and on the torque member comprising a plurality of cam followers and a plurality of cam surfaces respectively associated therewith.

4. A system as recited in claim 1, said torque member being a torque tube substantially concentrically over the gun tube for applying said counter torque symmetrically about the long axis of the gun tube.

5. A system as recited in claim 4, the means on the cradle and the means on the torque tube including at least one cam follower and at least one cam surface associated therewith, said cam surface inclined with respect to said gun tube axis.

6. A system as recited in claim 5, at least one of said cam follower and cam surface including resiliently yielding means.

7. A system as recited in claim 6, said torque in the second direction being non-linear with respect to said recoil.

8. A system as recited in claim 4, the means on the cradle comprising a plurality of cam followers and the means on the torque tube comprising structure defining a respective plurality of cam surfaces associated therewith.

9. A system as recited in claim 8, said structure defining a respective plurality of cam surfaces being resilient structure.

10. A system as recited in claim 8, said structure defining a respective plurality of cam surfaces being resilient structure.

11. A system as recited in claim 10, said plurality of apertures comprising said second end of the torque tube being defined by a plurality of arms.

12. A system as recited in claim 11, said arms being resilient.

13. A method of controlling muzzle torque about the axis of a rifled gun tube resulting from firing a projectile in said rifled gun tube comprising the steps:

(a) deriving a counter torque from gun tube recoil from said firing, and (b) applying said counter torque to said muzzle during said firing.

14. A method as recited in claim 13, in step (a) said deriving being through cam means and cam follower means at a gun cradle supporting said gun tube, and in step (b) said applying being through a torque member connecting said muzzle with one of said cam means and cam follower means.

15. A method as recited in claim 13, said counter torque being characterized by a non-linear torque curve in relation to recoil travel.

* * * * *

UNITED STATES PATENT AND TRADEMARK OFFICE

CERTIFICATE OF CORRECTION

PATENT NO. : 4,375,136
DATED : March 1, 1983
INVENTOR(S) : JOHN S. PEDGONAY

It is certified that error appears in the above-identified patent and that said Letters Patent are hereby corrected as shown below:

Claim 10, line 3, after "structure" insert -- having a plurality of apertures comprising said second end of the torque tube --.

In the Abstract, line 7, "aperture" should be --apertures--.

Signed and Sealed this

Fifth Day of July 1983

[SEAL]

*Attest:*

GERALD J. MOSSINGHOFF

*Attesting Officer* *Commissioner of Patents and Trademarks*